United States Patent [19]

Nomura et al.

[11] Patent Number: 4,762,763

[45] Date of Patent: Aug. 9, 1988

[54] TONER FOR DEVELOPING ELECTROSTATIC LATENT IMAGE

[75] Inventors: Yoshihiro Nomura, Numazu; Noriaki Ide, Fuji; Kazumi Ohtaki; Masami Tomita, both of Numazu; Hachiro Tosaka, Susono; Toshiki Nanya, Numazu; Motoi Orihara, Numazu; Shunichi Chiba, Numazu; Satoru Inoue, Mishima; Yasuo Asahina; Hiroyuki Fushimi, both of Numazu, all of Japan

[73] Assignee: Ricoh Co., Ltd., Tokyo, Japan

[21] Appl. No.: 939,386

[22] Filed: Dec. 8, 1986

[30] Foreign Application Priority Data

Dec. 19, 1985 [JP] Japan ..... 60-287318
Feb. 21, 1986 [JP] Japan ..... 61-38039
Jul. 11, 1986 [JP] Japan ..... 61-163371

[51] Int. Cl.[4] ..... G03G 9/10
[52] U.S. Cl. ..... 430/110
[58] Field of Search ..... 430/110

[56] References Cited

U.S. PATENT DOCUMENTS 4,206,064 6/1980 Kiuchi et al. ..... 430/110 X
4,407,924 10/1983 Senshu et al. ..... 430/110 X
4,656,112 4/1987 Kawagishi et al. ..... 430/110

*Primary Examiner*—Roland E. Martin
*Attorney, Agent, or Firm*—Flynn, Thiel, Boutell & Tanis

[57] ABSTRACT

This invention relates to a toner for developing an electrostatic latent image, which contains a coloring agent, a binder resin and a charge controlling agent as the main components, said charge controlling agent being a metal salt of salicylic acid or derivatives.

18 Claims, No Drawings

TONER FOR DEVELOPING ELECTROSTATIC LATENT IMAGE

BACKGROUND OF THE INVENTION (a) Field of the Invention

This invention relates to a dry type toner for developing an electrostatic latent image, particularly, a toner containing the specific compound as a charge controlling agent (polarity controlling agent).

This invention further relates to a toner for developing an electrostatic latent image, which comprises a combination of the specific binder resin and said specific charge controlling agent (polarity controlling agent).

(b) Description of the Prior Art

There are two types of systems for developing electrostatic latent images formed on an electrophotographic photosensitive material, electrostatic recording material and the like, one of which uses a wet type liquid developer (wet type developing method), and the other of which uses a dry type developer containing, for example, one component type toner having a coloring agent dispersed in a binder resin or two component type toner comprising a mixture of said one component type toner with a solid carrier (dry type developing method). These systems respectively have merits and demerits. Recently, the dry type developing method, particularly a two component type developer is generally used.

It is usual for the above mentioned toner (developing powder) to add an appropriate amount of a charge controlling agent (polarity controlling agent) to impart desired electrification properties since a toner prepared simply by dispersing a coloring agent such as dye, pigment and the like in a binder resin without adding any charge controlling agent does not have satisfactory electrification properties.

Examples of the conventionally known charge controlling agents include (i) an agent for imparting a positive charge to a toner such as nigrosine type dye and (ii) an agent for imparting a negative charge to a toner such as metal-containing dyes, for example, chromium-containing monoazo complex, metal complex of salicylic acid, chromium-containing salicylic acid compound complex, chlorine-containing organic dye (Copper Phthalocyanine Green, chlorine-containing monoazo dye), and the like. However, most of these conventional charge controlling agents have disadvantages that they are colored materials, that they have poor compatibility or wetting property with a binder resin, or that their charge controlling properties do not remain long because of subliming property. Thus, most of them are unsuitable as a charge controlling agent for a toner of electrophotography, particularly a color toner for use in a color copier. A toner containing these conventional charge controlling agents has favourable developing properties at the initial stage, but its life is short. It sometimes reverses electrification, thus the electrification properties (Q/M) being quite unstable. Moreover, its environmental stability is poor (stability to the changes of temperature and moisture is poor). In addition to these disadvantages, the transferring properties of the toner are poor when making multi-color copies such as three color copies or four color copies.

The above mentioned conventional coloring agents and charge controlling agents are disclosed in Japanese Patent Publication Nos. 48-25941, 48-26784, 49-20225, 46-43440, 48-30899, 49-46423 and 49-26909, and Japanese Patent Laid Open Nos. 50-140137, 50-142037, 50-142038, 49-51949, 49-134303 and 60-46566.

It is known to use a chlorinated paraffin, unsaturated polyester and the like as a binder resin for making a toner negatively electrified, or to use the specific polyester resin having a kind of cross-linking structure (reaction product of non-linear low melting aromatic resin with chelated salicylic acid) (see Japanese Patent Laid Open No. 59-29259), but these resins do not have a molecular weight desired for a binder resin, thus not having appropriate heat-properties (appropriate melting properties by heat roll during fixing) demanded for a toner. Therefore, these resins provide various problems as copy delivery miss caused by the winding of a copy about a heat roll, and "off-set" phenomenon that a developed image becomes unclear because a toner on a copy paper is tranferred to the surface of a roller.

It is also known to use metal complex of salicylic acid as a charge controlling agent (see Japanese Patent Publication No. 55-42752), but this compound is a colored chelated compound. Since this compound is not colorless but colored, it is not suitable for a color toner.

SUMMARY OF THE INVENTION

The first object of the present invention is to provide a toner for a one-component type or two-component type dry type electrophotographic developer, which is negatively electrified for a long time without damaging the original color of a coloring agent, by mixing a colorless charge controlling agent therewith. The second object of the present invention is to provide a toner having an excellent durability and environmental stability suitable for developing an electrostatic latent image at a high speed, which always produces a clear stable image without causing reversely charged toner even after continuously copying and without causing dirt (fog) and a copy paper. The third object of the present invention is to provide a dry type color toner having excellent multicolor-copying properties of full color, which does not cause "off set" phenomenon.

That is, an object of the present invention is to provide a toner for developing an electrostatic latent image, which contains a coloring agent, a binder resin and a charge controlling agent as the main components, said charge controlling agent being a metal salt of salicylic acid or derivatives thereof.

DETAILED DESCRIPTION OF THE INVENTION

The toner for developing an electrostatic latent image of the present invention contains a coloring agent, a binder resin and a charge controlling agent (polarity controlling agent) as the main components, said charge controlling agent being a metal salt of salicylic acid or derivatives thereof, and furthermore the toner for developing an electrostatic latent image of the present invention contains a coloring agent, a binder resin and a charge controlling agent as the main components, said charge controlling agent being a metal salt of salicylic acid or derivatives thereof and said binder resin being a polyester resin synthesized from a bisphenol type diol and a polycarboxylic acid.

We have variously studied the charge controlling properties of a dry type toner, and found that metal salts of salicylic acid and metal salts of salicylic acid derivatives are very effective as a charge controlling agent. As the results of the various studies of the developing properties and transferring properties of a dry type toner, we have discovered that quite a satisfactory toner can be obtained when at least one of the metal salts of salicylic acid and metal salts of salicylic acid derivatives are used as a charge controlling agent and a polyester resin is used as a binder resin. The present invention is based on this discovery.

The preferable metal salts of salicylic acid or derivatives in this invention are expressed by the following general formula,

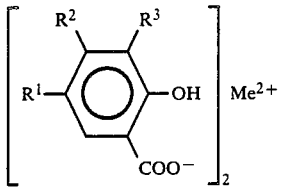

wherein $R^1$, $R^2$ and $R^3$ represent hydrogen, an aryl group or an alkyl group having 1 to 10 carbon atoms and Me represents any metal selected from the group consisting of zinc, nickel, cobalt, copper and chromium. This charge controlling agent may be used alone or in a mixture of two or more.

The metal salts as expressed by the above general formula can be easily synthesized by the method disclosed in "J. Amer. Chem. Soc." 70, 2151 by CLARK, J. L. Kao, H. (1948). For example, zinc salt of salicylic acid or salicylic acid derivatives can be produced by mixing 2 moles of sodium salicylate (or sodium salt of salicylic acid derivatives) with one mole of zinc chloride and stirring the resultant mixture in the presence of heat. The metal salt thus obtained is a white crystal and does not damage the color of a coloring agent when dispersed in a toner binder. Metal salts other then zinc salt can be produced in the same manner as mentioned above. According to the present invention, these metal salts may be used alone or in a mixture of two or more. The toner of the present invention contains the compounds thus obtained, a coloring agent and a binder resin as the essential components.

Any of the conventional binder resins can be used as a binder resin for the toner of the present invention, examples of which include styrene type resins (for example, polystyrene, styrene-acrylic acid copolymer, styrene-methacrylic acid copolymer, styrene-acrylate copolymer, styrene-methacrylic copolymer, styrene-butadiene copolymer, and the like), saturated polyester resin, unsaturated polyester resin, epoxy resin, phenolic resin, maleic acid resin, coumarone resin, chlorinated paraffin, xylene resin, vinyl chloride type resin, polypropylene, polyethylene, and the like. These resins may be used alone or in a mixture of two or more.

However, among the above mentioned resins, the polyester resin synthesized from bisphenol type diols and polycarboxylic acids is more preferable for the purposes of making the dispersibility of a coloring agent (pigments or dyes) favourable and keeping the electrification properties stable during the copying process to obtain a satisfactory image.

Examples of the bisphenol type diols used for preparing the specific polyester resin include:

(1) polyoxypropylene(2,2)-2,2-bis(4-hydroxyphenyl)-propane,
(2) polyoxyethylene(2)-2,2-bis(4-hydroxyphenyl)propane,
(3) polyoxystyrene(6)-2,2-bis(4-hydroxyphenyl)propane,
(4) polyhydroxybutylene(2)-2,2-bis(4-hydroxyphenyl)-propane,
(5) polyoxypropylene(3)-bis(4-hydroxyphenyl)-thioether,
(6) polyoxypropylene(2)-2,2-bis(4-cyclohexanol)propane,
(7) polyoxyethylene(2)-2,6-dichloro-4-hydroxyphenyl-propane,
(8) polyoxyethylene(2,5)-p,p-bisphenol,
(9) polyoxybutylene(4)-bis(4-hydroxyphenyl)ketone,
(10) oxyethylene-2,2-bis(4-hydroxyphenyl)propane, and
(11) oxypropylene-2,2-bis(4-hydroxyphenyl)propane.

Examples of the polycarboxylic acid used for preparing the specific polyester resin include maleic acid, fumaric acid, glutaric acid, phthalic acid, maleic anhydride, fumaric anhydride, phthalic anhydride, isophthalic acid, terephthalic acid, trimellitic acid, 1,2,4-benzenetricarboxylic acid, and the like.

Preferable examples of the polyester resin include (a) polyester resin having a softening point of about 100° C., synthesized from said diol (1) and fumaric acid (prepared by condensation reaction);
(b) polyester resin having a softening point of about 90° C., synthesized from said diol (2) and terephthalic acid;
(c) polyester resin having a softening point of about 110° C., synthesized from said diol (5) and isophthalic acid;
(d) polyester resin having a softening point of about 130° C., synthesized from said diol (1), fumaric acid and trimellitic acid; and
(e) polyester resin having a softening point of about 100° C., synthesized from said diol (10) and fumaric acid.

These polyester resins can be synthesized by the well known process, and the polyester resin thus synthesized preferably has a molecular weight of 3,000 to 20,000.

Synthesis examples of these polyester resins are illustrated hereinafter.

SYNTHESIS EXAMPLE 1

A polyester resin was synthesized by condensating 7 moles (1162 g) of terephthalic acid, 2 moles (420 g) of trimellitic acid, 8.84 moles (2457 g) of polyoxypropylene(2,2)-2,2-bis(4-hydroxyphenyl)propane and 0.16 mole (14.7 g) of glycerin in accordance with the well known process. A sufficient care must be taken during the process in order that each monomer is not distilled out or escaped, and if necessary the deficiency must be filled up.

SYNTHESIS EXAMPLE 2

A polyester resin was synthesized by condensating 9 moles of polyoxyethylene(2)-2,2-bis(4-hydroxyphenyl)-propane and 9 moles of terephthalic acid in accordance with the well known process.

SYNTHESIS EXAMPLE 3

A polyester resin was synthesized by condensating 9 moles of polyoxypropylene(3)-bis(4-hydroxyphenyl)-thioether and 9 moles of isophthalic acid in accordance with the well known process.

SYNTHESIS EXAMPLE 4

A polyester resin was synthesized by condensating 9 moles of polyoxypropylene(2,2)-2,2-bis(4-hydroxyphenyl)propane, 7 moles of terephthalic acid and 2 moles of trimellitic acid in accordance with the well known process.

Any of the conventional coloring agents for color toners of magenta, cyan, yellow and the like can be used in the present invention, examples of which include inorganic pigments such as ultramarine, prussian blue, silica, alumina, titanium and the like; and organic type dyes and pigments such as azo type dyes and pigments, anthraquinone type dyes and pigments, phthalocyanine type dyes and pigments, quinacridone type dyes and pigments, perylene type dyes and pigments, indigo type dyes and pigments, basic dyes and their lake salts. These coloring agents can be used in a mixture of two or more. If necessary, a black coloring agent such as carbon black can also be used. Among these coloring agents, phthalocyanine type dyes and pigments and Benzidine Yellow type pigments are particularly preferable.

Typical examples of the phthalocyanine type pigments include C.I. Pigment Blue 15, C.I. Pigment Blue 16, C.I. Pigment Blue 17, C.I. Pigment Green 7, C.I. Pigment Green 12, C.I. Pigment Green 36, C.I. Pigment Green 37, C.I. Pigment Green 38, and the like, and typical examples of the phthalocyanine type dyes include C.I. Solvent Blue 25, C.I. Solvent Blue 55, C.I. Solvent Blue 70, C.I. Direct Blue 25, C.I. Direct Blue 86, and the like. Coloring agents prepared by modifying these phthalocyanine type dyes and pigments can also be effectively used. Other blue or green type coloring agents can be blended with these phthalocyanine type dyes and pigments.

Typical examples of Benzidine Yellow type pigments include Benzidine Yellow (C.I. 21090), #2300 Dainichi Benzidine Yellow (C.I. 21090), Benzidine Yellow GR (C.I. 21090), Benzidine Yellow FGR (C.I. 21100), Sanyo Light Fast Benzidine Yellow R (C.I. 21100), Benzidine Yellow GE (C.I. 21100), and the like.

In addition to the above components, the toner of the present invention may further contain additives, for example, a plasticizer such as dibutyl phthalate, dioctyl phthalate and the like for the purposes of controlling thermal property, electric property, physical property and the like of the toner and a resistance modifier such as tin oxide, lead oxide, antimony oxide and the like.

A part of the above mentioned preferable polyester binder resin may be replaced by other resins or said polyester binder resin may be blended with other resins. In any case, said polyester resin should preferably be present in an amount of at least 50% by weight of the total binder resin.

Examples of the above mentioned resins used for replacing or blending with said polyester resin include styrene or its substituted homopolymers such as polystyrene, poly-p-chlorostyrene, polyvinyl toluene, and the like; styrene type copolymers such as styrene-p-chlorostyrene copolymer, styrene-propylene copolymer, styrene-vinyl toluene copolymer, styrene-vinyl naphthalene copolymer, styrene-methylacrylate copolymer, styrene-ethylacrylate copolymer, styrene-butylacrylate copolymer, styrene-octylacrylate copolymer, styrene-methylmethacrylate copolymer, styrene-ethylmethacrylate copolymer, styrene-butylmethacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, and the like; polyvinyl chloride, polyvinyl acetate, polyethylene, polypropylene, silicone resin, polyester, polyurethane, polyamide, epoxy resin, polyvinyl butyral, rosin, modified rosin, terpene resin, phenolic resin, xylene resin, aliphatic or cycloaliphatic hydrocarbon resin, aromatic petroleum resin, chlorinated paraffin, paraffin wax, and the like.

The above mentioned metal salt used as a charge controlling agent for the toner of the present invention is contained preferably in an amount of 0.1 to 10 parts by weight, more preferably 0.5 to 7 parts by weight per 100 parts by weight of a binder resin.

The coloring agent for the toner of the present invention is used in an amount of 0.1 to 30 parts by weight, preferably 0.5 to 10 parts by weight, more preferably 1 to 7 parts by weight per 100 parts by weight of a binder resin.

After preparing toner particles (about 5 to 20 μm), the toner of the present invention may further contain a fluidity improver such as powdery $TiO_2$, $Al_2O_3$, $SiO_2$ and the like for improving the fluidity of the toner by coating the surface of the toner particles with these powders, and an agent for preventing the degradation of photosensitive material such as zinc stearate, phthalic acid and the like.

The toner of the present invention can be used as a one-component type developer for "touch down" system or may be used as a normal one-component type developer by dispersing magnetic material (magnetite powder and the like) in the toner.

The toner of the present invention may also be used as a two-component type developer by mixing with carrier particles.

Conventional carriers may be used. The preferable carrier may be prepared by coating a core material having a particle size of 50 to 300 μm selected from the group of iron powder, nickel powder, ferrite powder, glass powder and the like, with a resin such as styrene-acrylate copolymer, styrene-methacrylate copolymer, acrylate copolymer, methacrylate polymer, silicone resin, polyamide resin, ionomer resin, polyphenylene sulfide resin, etc.

A carrier is mixed with a toner generally in an amount of 10 to 1,000 parts by weight per one part by weight of toner.

The present invention is further illustrated by the following Examples and Comparative Examples. All the parts used herein mean parts by weight.

EXAMPLE 1

| | |
|---|---|
| Styrene-n-butylmethacrylate copolymer | 100 parts |
| Copper Phthalocyanine Blue (Lionogen Blue KL manufactured by Toyo Ink Co.) | 5 parts |
| zinc 3,5-di-t-butylsalicylate | 3 parts |

The above components were melt-kneaded in a hot roll mill. After cooling the kneaded mixture, the mixture was roughly ground by a hammer mill and further finely pulverized by a powdering machine employing air jet system. The pulverized powder was classified into particles having a particle size of 5 to 20 μm, thus producing a blue toner of the present invention. 3.5 parts of this toner was mixed with 100 parts of a carrier (spherical ferrite powder of a particle size of about 100 μm coated with silicone resin in a coating thickness of about 1 μm) to prepare a two-component dry type developer. The electrified amount of this developer measured by Blow-off Method was −18 μc/g.

A copy was made using the above prepared developer by a dry type electrophotographic copier (Ricopy FT5050 manufactured by Ricoh Co.) under the environmental conditions of 10° C., 15% relative humidity and 20° C., 60% relative humidity. As this result, a clear blue toner image having no fog was obtained. Even after continuously making 50,000 copies, the quality of the copies was not lowered. Furthermore, 10,000 copies were continuously made under the environment of 30° C., 90% relative humidity, but the quality of the copies did not change and the satisfactory quality was maintained.

The same test was repeated as mentioned above, except that chromium salt was used in place of zinc 3,5-di-t-butylsalicylate as a charge controlling agent, but an allowable result was obtained although the copy quality was slightly lowered when using the cromium salt than in the case of using the zinc salt.

COMPARATIVE EXAMPLE 1

A comparative two-component dry type developer was prepared in quite the same manner as in Example 1, except that a comparative toner was prepared from the following components:

| | |
|---|---|
| Styrene-2-hexylethylacrylate-n-butylmethacrylate copolymer | 100 parts |
| Copper Phthalocyanine Blue (Lionogen Blue KL manufactured by Toyo Ink Co.) | 5 parts |
| Chromium-containing monoazo complex | 0.5 part |

The electrified amount of this comparative developer measured by Blow-off Method was −7 μc/g.

A copy was made using the above prepared comparative developer in the same manner as in Example 1, thus producing a copy of dark bluish color tone. After continuously making 5,000 copies, the electrified amount measured by Blow-off Method was lowered to less than −5 μc/g, and the ground of the copied paper was stained. The copy image thus obtained was blurred and was not satisfactory.

COMPARATIVE EXAMPLE 2

A comparative two-component dry type developer was prepared in quite the same manner as in Example 1, except that a comparative greenish blue toner was prepared from the following components:

| | |
|---|---|
| Styrene-n-butylmethacrylate copolymer | 100 parts |
| Copper Phthalocyanine Blue (Lionogen Blue KL manufactured by Toyo Ink Co.) | 5 parts |
| Chromium complex compound of 3,5-di-t-butylsalicylic acid | 0.5 parts |

The electrified amount of this comparative developer measured by Blow-off Method was −13 μc/g.

A copy was made using the above prepared comparative developer in the same manner as in Example 1, thus producing a copy of slightly blurred blue color tone. After continuously making 5,000 copies, the electrified amount measured by Blow-off Method was lowered to −6 μc/g, and the ground of the copied paper was stained. The copy image thus obtained was blurred and was not satisfactory. A copy was further made continuously under the environment of 30° C. and 90% relative humidity, and consequently the electrified amount was lowered to −3 μc/g, and the ground of the copied paper was badly stained.

EXAMPLE 2

A two-component dry type developer was prepared in quite the same manner as in Example 1, except that the pigment was replaced by a yellow dye (Neozapon Yellow 073). The electrified amount of this comparative developer measured by Blow-off Method was −20 μc/g.

A copy was made using the above prepared developer in the same manner as in Example 1, thus producing a copy of yellow toner image having no fog. Even after continuously making 10,000 copies, the quality of the copy was not lowered.

EXAMPLE 3

A two-component dry type developer was prepared in quite the same manner as in Example 1, except that a red toner having a particle size of 5 to 20 μm was prepared from the following components:

| | |
|---|---|
| Styrene-n-butylmethacrylate copolymer | 100 parts |
| zinc 3,5-di-t-butylsalicylate (Bontron E-84 manufactured by Orient Kagaku) | 3 parts |
| Naphthol Red FGR (manufactured by Hoechst) | 5 parts |

The electrified amount of this comparative developer measured by the Blow-off Method was −21 μc/g.

60,000 copies were continuously made using the above prepared developer by a dry type electrophotographic copier (Ricopy FT4040 manufactured by Ricoh Co.), but a stable satisfactory red copy could be continuously produced even thereafter.

EXAMPLE 4

A two-component dry type developer was prepared in quite the same manner as in Example 1, except that a green toner having a particle size of 5 to 20 μm was prepared from the following components:

| | |
|---|---|
| Styrene-n-butylmethacrylate copolymer | 100 parts |
| zinc 3,5-di-t-butylsalicylate (Bontron E-84 manufactured by Orient Kagaku) | 3 parts |
| Copper Phthalocyanine Blue (Lionogen Blue MG5 manufactured by Toyo Ink Co.) | 2 parts |
| Lionol Yellow FGN-T (manufactured by Toyo Ink Co.) | 5 parts |

The electrified amount of this developer measured by Blow-off Method was −15 μc/g.

60,000 copies were continuously made using the above prepared developer by a dry type electrophotographic copier (Ricopy FT4060 manufactured by Ricoh Co.), but a stable satisfactory green copy could be continuously produced even thereafter.

EXAMPLE 5 A two-component dry type developer was prepared in quite the same manner as in Example 1, except that a toner having a particle size of 5 to 20 μm was prepared from the following components:

| | |
|---|---|
| Styrene-n-butylmethacrylate copolymer | 100 parts |
| Polypropylene (Viscol 330P manufactured by Sanyo Kasei Co.) | 4 parts |
| Carbon black | 13 parts |
| zinc 3,5-di-t-butylsalicylate | 2 parts |

The electrified amount of this developer measured by Blow-off Method was −20 μc/g.

A copy was made using the above prepared developer in the same manner as in Example 1, thus producing a black toner image having no fog. Even after continuously making 20,000 copies, the copy quality was not lowered.

A copy was further made using the above prepared developer by an electrophotographic copier (Reversal Developing Machine, My Ricopy M5 manufactured by Ricoh Co.) employing "touch down" developing system. The electrified amount of a toner on a developing sleeve was −15 μc/g, and a clear black image having no fog was obtained. Even after continuously making 20,000 copies, the copy quality was not lowered. The electrified amount of the toner was measured on the basis of the charge amount of the toner flown when suctioned from the developing sleeve and the weight of the suctioned toner.

EXAMPLE 6

A toner having a particle size of 5 to 15 μm was prepared in quite the same manner as in Example 1, except that the following components were used.

| | |
|---|---|
| Styrene-n-butylmethacrylate copolymer | 50 parts |
| $Fe_3O_4$ (EPT 500 manufactured by Toda Kogyo Co.) | 50 parts |
| zinc 3,5-di-t-butylsalicylate | 2 parts |

A copy was made using the above prepared toner by an electrophotographic copier (Reversal Developing Machine, My Ricopy M10 manufactured by Ricoh Co.) employing "touch down" developing system. The electrified amount of a toner on a developing sleeve was −10 μc/g, and a clear black image having no fog was produced. Even after continuously making 20,000 copies, the copy quality was not lowered.

COMPARATIVE EXAMPLE 3

A toner having a particle size of 5 to 20 μm was prepared in quite the same manner as in Example 6, except that the following components were used.

| | |
|---|---|
| Styrene-n-butylmethacrylate copolymer | 50 parts |
| BL-25O ($Fe_3O_4$ magnetite manufactured by Titanium Kogyo Co.) | 50 parts |
| Bontoron S-34 (chromium-containing complex manufactured by Orient Kagaku) | 2 parts |

A copy was made using the above prepared developer by an electrophotographic copier (My Ricopy M10 manufactured by Ricoh Co.). The electrified amount of a toner on a developing sleeve was −15 μc/g at the initial stage, and a clear black image having no fog was developed. After continuously making 5,000 copies, the electrified amount of a toner on a developing sleeve was lowered to −4 μc/g, and the ground of the copied paper was stained, the image developed being blurred.

EXAMPLE 7

A toner having a particle size of 5 to 20 μm was prepared in quite the same manner as in Example 1, except that the following components were used.

| | |
|---|---|
| Saturated polyester resin | 50 parts |
| Polypropylene (Viscol 330 manufactured by Sanyo Kasei Co.) | 3 parts |
| $Fe_3O_4$ (black magnetic material EPT 500 manufactured by Toda Kogyo Co.) | 30 parts |
| zinc 3,5-di-t-butylsalicylate | 2 parts |

A copy was made using the above prepared developer by an electrophotographic copier (Reversal Developing Machine, My Ricopy M10 manufactured by Ricoh Co.) The electrified amount of a toner on a developing sleeve was −13 μc/g, and a clear image having no fog was developed. Even after continuously making 20,000 copies, the copy quality was not lowered.

EXAMPLE 8

| | |
|---|---|
| Polyester resin prepared by the above Synthesis Example 1 | 100 parts |
| Copper Phthalocyanine Blue (Lionogen Blue KL manufactured by Toyo Ink Co.) | 5 parts |
| zinc 3,5-di-t-butylsalicylate | 3 parts |

The above components were melt-kneaded in a hot roll mill. After cooling the kneaded mixture, the mixture was roughly ground by a hammer mill and further finely pulverized by a powdering machine employing air jet system. The pulverized powder was classified into particles having a particle size of 5 to 15 μm. 0.5 part of hydrophobic silica was admixed with 100 parts of the above classified powder, thus producing a blue toner of the present invention. 3.5 parts of the toner thus prepared was mixed with 100 parts of a carrier (amorphous iron powder of a particle size of about 50 to 100 μm) to prepare a two-component dry type developer.

A copy was made using the above prepared developer by a dry tape electrophotographic copier (Ricopy FT 6080 manufactured by Ricoh Co.) under the environmental conditions of 10° C., 15% relative humidity and 20° C., 60% relative humidity. As this result, a clear and sharp blue toner image without fog, blur, unevenness and the like was developed. Even after continuously making 20,000 copies, the quality of the copies was not lowered. Furthermore, 10,000 copies were continuously made under the environment of 30° C. and 90% relative humidity, but the quality of the copies did not change and the satisfactory quality was maintained.

The same test was repeated as mentioned above, except that chromium salt was used in place of zinc 3,5-di-t-butylsalicylate as a charge controlling agent, but an allowable result was obtained although the copy quality was slightly lowered when using the chromium salt than in the case of using the zinc salt.

Thereafter, a full color copy was made by using the above prepared developer as a cyan developer in the cyan developing section of a full color electrophotographic copier (Color 5000 manufactured by Ricoh Co.). As this result, a satisfactory full color image without fog, blur, unevenness and the like was developed.

Three other toners were prepared in the same manner as above, except that the resin of Synthesis Example 1 as a binder resin was replaced respectively by the resins of Synthesis Examples 2, 3 and 4, and the electrified amounts (Q/M) of the respective toners during continuously copying were measured. The measured values are shown in the following Table 1.

TABLE 1

| | Initial Stage | After making 20,000 copies (Unit: μc/g) |
|---|---|---|
| Resin of Synthesis Ex. 1 | −21.9 | −16.5 |
| Resin of Synthesis Ex. 2 | −19.2 | −16.7 |
| Resin of Synthesis Ex. 3 | −22.1 | −18.0 |
| Resin of Synthesis Ex. 4 | −21.1 | −17.2 |

The toner prepared by using the specific polyester binder resin in this Example 8 produced a more satisfactory image having a good stability without no fog in comparison with the toner of Example 1 prepared by using styrene-n-butylmethacrylate copolymer as a binder resin.

COMPARATIVE EXAMPLE 4

A comparative two-component dry type developer was prepared in quite the same manner as in Example 8, except that zinc 3,5-di-t-butylsalicylate as a charge controlling agent was not used.

A copy was made using the above prepared comparative developer in the same manner as in Example 8, but fog appeared on the copied paper after continuously making 100 copies. After continously making 500 copies, the electrified amount (Q/M) was −30.5 μc/g (−16.0 μc/g at the initial stage), and the image density was lowered, the fog having appeared badly on the copied paper. At the stage of making 1,000 copies, the developing power was substantially lost.

A full color copy was made by using the above prepared toner as a cyan color toner in the cyan developing section of a full color electrophotographic copier (Color 5000 manufactured by Ricoh Co.) but an unsatisfactory copy of bad image quality was developed from the initial stage having unevenness due to the uneven transfer of the toner.

EXAMPLE 9

A two-component dry type developer was prepared in quite the same manner as in Example 8, except that a blue toner of a particle size of 5 to 15 μm having silica added thereto was prepared from the following components:

| | |
|---|---|
| Resin prepared by Synthesis Example 1 | 70 parts |
| Styrene-butylacrylate copolymer | 30 parts |
| C.I. Pigment Blue 15 | 2 parts |
| C.I. Solvent Blue 25 | 2 parts |
| zinc 3,5-di-t-butylsalicylate (Bontron E-84 manufactured by Orient Kagaku) | 2 parts |

20,000 copies were continuously made using the above prepared developer by an electrophotographic copier (Ricopy FT6080 manufactured by Ricoh Co.), but a stable satisfactory blue copy could be continuously made even thereafter.

The electrified amount of this developer was −18.0 μc/g at the initial stage, and −14.4 μc/g at the stage of continuously making 20,000 copies.

The same test was repeated as mentioned above, except that chromium salt was used in place of zinc 3,5-di-t-butylsalicylate as a charge controlling agent, but an allowable result was obtained although the copy quality was slightly lowered when using the chromium salt than in the case of using the zinc salt.

Thereafter, a full color copy was made by using the above prepared developer as a cyan developer in the cyan developing section of a full color electrophotographic copies (Color 5000 manufactured by Ricoh Co.). As this result, a satisfactory full color image without fog, blur, unevenness and the like was developed.

COMPARATIVE EXAMPLE 5

A comparative two-component dry type developer was prepared in quite the same manner as in Example 9, except that zinc 3,5-di-t-butylsalicylate charge controlling agent was not used.

A copy was continuously made using the above prepared comparative developer by an electrophotographic copier (Ricopy FT6080 manufactured by Ricoh Co.), but fog appeared on the copied paper after continuously making 500 copies and the electrified amount was lowered to less than −5 μc/g (−14.8 μc/g at the initial stage). After continuously making 1,000 copies, the scattering of toner became severe and the image quality was lowered because of the occurrence of fog.

EXAMPLE 10

A two-component dry type developer was prepared in quite the same manner as in Example 8, except that a bluish green toner having a particle size of 5 to 15 μm was prepared from the following components:

| | |
|---|---|
| Resin prepared by Synthesis Example 1 | 70 parts |
| Styrene-acrylic acid copolymer | 30 parts |
| C.I. Pigment Blue 17 | 2 parts |
| C.I. Pigment Green | 1 parts |
| zinc 3,5-di-t-butylsalicylate (Bontron E-84 manufactured by Orient Kagaku) | 2 parts |

20,000 copies were continuously made using the above prepared developer by an electrophotographic copier (Ricopy FT6080 manufactured by Ricoh Co.), and a stable satisfactory bluish green copy could be continuously made even thereafter.

The same test was repeated as mentioned above, except that chromium salt was used in place of zinc 3,5-di-t-butylsalicylate as a charge controlling agent, but an allowable result was obtained although the copy quality was slightly lowered when using the chromium salt than in the case of using the zinc salt.

Thereafter, a full color copy was made by using the above prepared developer as a cyan developer in the cyan developing section of a full color electrophotographic copier (Color 5000 manufactured by Ricoh Co.). As this result, a satisfactory full color image without fog, blur, unevenness and the like was developed.

EXAMPLE 11

A two-component dry type developer was prepared in quite the same manner as in Example 8, except that a yellow toner having 0.5 part of silica added thereto was prepared by using Benzidine Yellow (manufactured by Tokyo Shikizai Co.) in place of Copper Pthalocyanine Blue.

20,000 copies were continuously made using the above prepared developer in the same manner as in Example 10, and a stable satisfactory yellow copy could be continuously made ever thereafter.

A full color copy was made in the same manner as in Example 10 by using the above prepared developer as a yellow developer in the yellow developing section of a full color electrophotographic copier. As this result, a satisfactory full color image could be developed in the same manner as in Example 10. The variation of Q/M value with the lapse of time and the evaluation of the image quality are shown in the following Table 2.

COMPARATIVE EXAMPLE 6

A comparative two-component dry type developer was prepared in the same manner as in Example 8, except that a yellow toner was prepared from the following components:

| | |
|---|---|
| Resin prepared by Synthesis Example 1 | 100 parts |
| Benzidine Yellow (manufactured by Tokyo Shikizai Co.) | 5 parts |

A copy was continuously made using the above prepared comparative developer by an electrophotographic copier (Ricopy FT6080 manufactured by Ricoh Co.), but fog appeared on the copied paper after continuously making 100 copies. After continuously making 500 copies, the electrified amount (Q/M value) was increased, and the occurrance of fog became severe with the image density being lowered. At the stage of making 1,000 copies, the developing power was substantially lost.

A full color copy was made by using the above prepared comparative toner as a yellow color toner in the yellow developing section of a full color electrophotographic copier (Color 5000 manufactured by Ricoh Co.), but an unsatisfactory copy of bad image quality was produced from the initial stage having unevenness due to the uneven transfer of the toner.

The variation of Q/M value with the lapse of time and the evaluation of the image quality are shown in the following Table 2.

EXAMPLE 12

A two-component dry type developer was prepared in quite the same manner as in Example 8, except that a yellow toner having 0.5 part of silica added thereto was prepared from the following components:

| | |
|---|---|
| Resin prepared by Synthesis Example 2 | 70 parts |
| Styrene-acrylic acid copolymer | 30 parts |
| Benzidine Yellow (manufactured by Tokyo Shikizai Co.) | 2 parts |
| zinc 3,5-di-t-butylsalicylate | 2 parts |

20,000 copies were continuously made using the above prepared developer in the same manner as in Example 10, but a satisfactory copy having no fog was produced without lowering the image quality due to the transfer of toner.

The variation of Q/M value with the lapse of time and the evaluation of the image quality are shown in the following Table 2.

COMPARATIVE EXAMPLE 7

A comparative two-component dry type developer was prepared in the same manner as in Example 8, except that a yellow toner was prepared from the following component:

| | |
|---|---|
| Resin prepared by Synthesis Example 2 | 70 parts |
| Styrene-acrylic acid copolymer | 30 parts |
| Benzidine Yellow (manufactured by Tokyo Shikizai Co.) | 2 parts |

A copy was continuously made using the above prepared comparative developer by an electrophotographic copier (Ricopy FT6080 manufactured by Ricoh Co.), but fog appeared on the copied paper and Q/M value was lowered to less than $-10\ \mu c/g$ after continuously making 500 copies. After continuously making 1,000 copies, the scattering of toner became severe and the image quality was lowered because of fog.

The variation of Q/M value with the lapse of time and the evaluation of the image quality are shown in the folowing Table 2.

TABLE 2

(Unit: $\mu c/g$)

| | | Initial Stage | after making 100 copies | after making 500 copies | after making 1,000 copies | after making 10,000 copies | after making 20,000 copies |
|---|---|---|---|---|---|---|---|
| Ex. 11 | Q/M | −27.0 | −25.2 | −22.4 | −24.0 | −23.3 | −24.1 |
| | Image Quality | ◎ | ◎ | ◎ | ◎ | ◎ | ◎ |
| Ex. 12 | Q/M | −23.0 | −21.5 | −20.1 | −19.5 | −21.3 | −19.2 |
| | Image Quality | ◎ | ◎ | ◎ | ◎ | ◎ | ◎ |
| Comparative Ex. 6 | Q/M | −24.1 | −26.8 | −29.6 | — | — | — |
| | Image Quality | ○ | X | XX | — | — | — |
| Comparative Ex. 7 | Q/M | −18.0 | −13.4 | −9.1 | −8.7 | — | — |
| | Image Quality | ◎ | Δ | X | XX | — | — |

Note:
Image quality was evaluated as ◎ (excellent), ○ (good), Δ (fair), X (bad), and XX (worse).

As can be seen from the above Examples, the toner of the present invention containing the specific metal salts (particularly zinc salt of salicylic acid and/or salicylic acid derivatives) as a charge controlling agent is not influenced by temperature and moisture conditions, and is very useful for producing a great number of copies.

What we claim is:

1. A toner for developing an electrostatic latent image, which contains a coloring agent, a binder resin and a charge controlling agent as the main components, said charge controlling agent being a metal salt of salicylic acid or derivatives thereof expressed by the following general formula

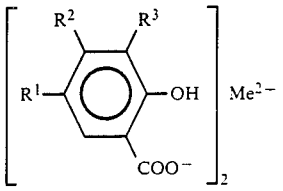

wherein $R^1$, $R^2$ and $R^3$ is/are hydrogen, aryl group or an alkyl group having 1 to 10 carbon atoms and Me is a metal selected from the group consisting of zinc, nickel, cobalt, copper and chromium.

2. The color toner as claimed in claim 1, wherein said charge controlling agent is a zinc salt of salicylic acid or derivatives thereof.

3. The color toner as claimed in claim 1, wherein said charge controlling agent is contained in an amount of 0.1 to 10 parts by weight per 100 parts by weight of said binder resin.

4. The color toner as claimed in claim 3, wherein said charge controlling agent is contained in an amount of 0.5 to 7 parts by weight per 100 parts by weight of said binder resin.

5. The toner as claimed in claim 1, wherein said color toner is mixed with a carrier prepared by coating a core material selected from the group consisting of iron powder, nickel powder, ferrite powder, and glass powder with a resin selected from the group consisting of styrene-acrylate copolymer, styrene-methacrylate copolymer, acrylate polymer, methacrylate polymer, silicone resin, polyamide resin, ionomer resin, and polyphenylene sulfide resin.

6. The toner as claimed in claim 1, wherein said toner further contains at least one additive selected from the group consisting of a plasticizer selected from the group consisting of dibutyl phthalate and dioctyl phthalate, (ii) a resistance modifier selected from the group consisting of tin oxide, lead oxide and antimony oxide, (iii) a fluidity improver selected from the group consisting of $TiO_2$, $Al_2O_3$ and $SiO_2$, and (iv) an agent for preventing the degradation of photosensitive material selected from the group consisting of zinc stearate and phthalic acid.

7. The toner as claimed in claim 1, wherein said binder resin is a polyester resin synthesized from a bisphenol diol and a polycarboxylic acid.

8. The toner as claimed in claim 7, wherein said polyester resin has a molecular weight of 3,000 to 20,000.

9. The toner as claimed in claim 7, wherein said polyester resin is synthesized from at least one of the bisphenol diols selected from the group consisting of (1) polyoxypropylene(2,2)-2,2-bis(4-hydroxyphenyl)-propane,
(2) polyoxyethylene(2)-2,2-bis(4-hydroxyphenyl)propane,
(3) polyoxyestyrene(6)-2,2-bis(4-hydroxyphenyl)propane,
(4) polyhydroxybutylene(2)-2,2-bis(4-hydroxyphenyl)propane,
(5) polyoxypropylene(3)-bis(4-hydroxyphenyl)-thioether,
(6) polyoxypropylene(2)-2,2-bis(4-cyclohexanol)propane,
(7) polyoxyethylene(2)-2,6-dichloro-4-hydroxyphenylpropane,
(8) polyoxyethylene(2,5)-p,p-bisphenol,
(9) polyoxybutylene(4)-bis(4-hydroxyphenyl)ketone,
(10) oxyethylene-2,2-bis(4-hydroxyphenyl)propane, and
(11) oxypropylene-2,2-bis(4-hydroxyphenyl)propane, and at least one of the polycarboxylic acids selected from the group consisting of maleic acid, fumaric acid, glutaric acid, phthalic acid, maleic anhydride, fumaric anhydride, phthalic anhydride, isophthalic acid, terephthalic acid, trimellitic acid and 1,2,4-benzenetricarboxylic acid.

10. The toner as claimed in claim 9, wherein said polyester resin is at lest one member selected from the group consisting of:

(a) polyester resin having a softening point of 100° C., synthesized from said diol (1) and fumaric acid;
(b) polyester resin having a softening point of 90° C., synthesized from said diol (2) and terephthalic acid;
(c) polyester resin having a softening point of 110° C., synthesized from said diol (5) and isophthalic acid;
(d) polyester resin having a softening point of 130° C., synthesized from said diol (1), fumaric acid and trimellitic acid; and
(e) polyester resin having a softening point of 100° C., synthesized from said diol (10) and fumaric acid.

11. The toner as claimed in claim 7, wherein a part of said polyester binder resin is replaced in an amount of less than 50% by weight of the total binder resin by at least one member selected from the group consisting of polystyrene, poly-p-chlorostyrene, polyvinyl toluene, styrene-p-chlorostyrene copolymer, styrene-propylene copolymer, styrene-vinyl toluene copolymer, styrene-vinyl naphthalene copolymer, styrene-methylacrylate copolymer, styrene-ethylacrylate copolymer, styrene-butylacrylate copolymer, styrene-octylacrylate copolymer, styrene-methylmethacrylate copolymer, styrene-ethylmethacrylate copolymer, styrene-butylmethacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, polyvinyl chloride, polyvinyl acetate, polyethylene, polypropylene, silicone resin, polyester, polyurethane, polyamide, epoxy resin, polyvinyl butyral, rosin, modified rosin, terpene resin, phenolic resin, xylene resin, aliphatic or cycloaliphatic hydrocarbon resin, aromatic petroleum resin, chlorinated paraffin, and paraffin wax.

12. The toner as claimed in claim 7, wherein said toner is mixed with a carrier prepared by coating a core material selected from the group consisting of iron powder, nickel powder, ferrite powder, and glass powder with a resin selected from the group consisting of styrene-acrylate copolymer, styrene-methacrylate copolymer, acrylate polymer, methacrylate polymer, silicone resin, polyamide resin, ionomer resin, and polyphenylene sulfide resin.

13. The toner as claimed in claim 7, wherein said toner further contains at least one additive selected from the group consisting of (i) a plasticizer selected from the group consisting of dibutyl phthalate and dioctyl phthalate, (ii) a resistance modifier selected from the group consisting of tin oxide, lead oxide and antimony oxide, (iii) a fluidity improver selected from the group consisting of $TiO_2$, $Al_2O_3$ and $SiO_2$, and (iv) an agent for preventing the degradation of photosensitive material selected from the group consisting of zinc stearate and phthalic acid.

14. The toner of claim 1, wherein the charge controlling agent is zinc 3,5-di-t-butylsalicylate.

15. The toner of claim 14, wherein the coloring agent comprises Copper Phthalocyanine Blue.

16. The toner of claim 14, wherein the coloring agent comprises Neozapon Yellow 073.

17. The toner of claim 14, wherein the coloring agent comprises Naphthol Red FGR.

18. The toner of claim 15, wherein the coloring agent also comprises Linol Yellow FGN-T.

* * * * *